US010969084B2

(12) United States Patent
Yang et al.

(10) Patent No.: US 10,969,084 B2
(45) Date of Patent: Apr. 6, 2021

(54) LAMP WITH ELONGATED HOUSING

(71) Applicants: Self Electronics Co., Ltd., Ningbo (CN); Wanjiong Lin, Ningbo (CN); Self electronics USA Corporation, Norcross, GA (US)

(72) Inventors: Jun Yang, Zhejiang (CN); Jianguo Dong, Zhejiang (CN); Kai Xu, Zhejiang (CN); Tonghua Huang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/554,320

(22) Filed: Aug. 28, 2019

(65) Prior Publication Data

US 2020/0072443 A1 Mar. 5, 2020

(30) Foreign Application Priority Data

Aug. 31, 2018 (CN) ..... 201811012837.2

(51) Int. Cl.

| | |
|---|---|
| ***F21V 15/015*** | (2006.01) |
| ***F21S 8/00*** | (2006.01) |
| ***F21V 19/00*** | (2006.01) |
| ***F21V 21/00*** | (2006.01) |
| ***F21V 17/10*** | (2006.01) |
| *F21Y 115/10* | (2016.01) |

(52) U.S. Cl.

CPC ..... *F21V 15/015* (2013.01); *F21S 8/00* (2013.01); *F21V 17/10* (2013.01); *F21V 19/0015* (2013.01); *F21V 21/00* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 6,406,161 | B1 * | 6/2002 | Lin | F21S 8/00 362/249.03 |
| 7,066,619 | B2 * | 6/2006 | Waters | F21S 8/033 362/147 |
| 7,591,572 | B1 * | 9/2009 | Levine | A47F 11/10 362/191 |
| 7,699,492 | B2 * | 4/2010 | Levine | F21V 21/0885 362/157 |
| 9,167,636 | B2 * | 10/2015 | Jin | F21V 21/00 |
| 2005/0007778 | A1 * | 1/2005 | Lin | F21V 21/32 362/249.07 |

(Continued)

*Primary Examiner* — Elmito Breval

(74) *Attorney, Agent, or Firm* — Wang Law Firm, Inc.

(57) ABSTRACT

The invention relates to a lamp with elongated housing, comprising elongated housing and at least a light-emitting unit arranged on the housing; each of the light-emitting unit comprising: light source arranged in the housing; fastening member arranged in the housing; mounting hole arranged on the outer wall of the housing; lamp holder arranged in the mounting hole and fastened to the fastening member; lens arranged in the lamp holder. In the present invention, each light source can be provided with a lamp holder, and the light emitted by each light source can be emitted through the lens on the corresponding lamp holder, so that the beam angle of each light source can be controlled in a small range to form a light spot.

9 Claims, 10 Drawing Sheets

(56) References Cited

U.S. PATENT DOCUMENTS

| | | | | |
|---|---|---|---|---|
| 2005/0168627 | A1* | 8/2005 | Yi | H04N 5/2252 348/373 |
| 2006/0072327 | A1* | 4/2006 | Schaak | F21V 21/32 362/382 |
| 2006/0203478 | A1* | 9/2006 | Waters | F21L 14/023 362/217.13 |
| 2008/0130277 | A1* | 6/2008 | Waters | F21L 14/023 362/227 |
| 2008/0285265 | A1* | 11/2008 | Boissevain | F21S 8/086 362/218 |
| 2011/0051429 | A1* | 3/2011 | Cheng | F21S 6/003 362/371 |
| 2014/0347847 | A1* | 11/2014 | Chung | F21V 21/06 362/147 |
| 2015/0323162 | A1* | 11/2015 | Xu | F21V 17/02 362/311.02 |
| 2015/0362148 | A1* | 12/2015 | Katz | F21S 6/003 362/16 |
| 2018/0058647 | A1* | 3/2018 | He | F21V 23/06 |
| 2019/0120443 | A1* | 4/2019 | Xia | F21S 6/003 |
| 2019/0137055 | A1* | 5/2019 | Liu | F21V 17/06 |
| 2019/0137083 | A1* | 5/2019 | Liu | F21V 14/02 |
| 2020/0248893 | A1* | 8/2020 | Jeon | F21V 15/015 |

* cited by examiner

LAMP WITH ELONGATED HOUSING

RELATED APPLICATION

This application claims priority to Chinese Patent Application No. CN 201811012837.2, filed on Aug. 31, 2018.

FIELD OF THE TECHNOLOGY

The present invention relates to lighting field, with particular emphasis on a lamp with elongated housing.

BACKGROUND OF THE INVENTION

For a lamp with an elongated housing, since the lamp has a small mounting space in its width direction, making the mounting structure unable to be provided, and the elongated housing of the lamp is generally thin in wall thickness, making it impossible to provide the threaded mounting hole on the elongated housing of the lamp, it is generally impossible to provide a lens on the light source for a lamp with an elongated housing. Therefore, for a lamp with an elongated housing, since there is no lens, the light emitted by the light source is dispersed, making it impossible to form light spot, so that a focused illumination cannot be formed on a certain area, and a certain area or an object cannot be under highlighted illumination.

BRIEF SUMMARY OF THE INVENTION

In view of the above, it is necessary to provide a lamp with elongated housing to overcome the above disadvantages.

A lamp with elongated housing comprises: elongated housing; at least a light-emitting unit arranged on the housing; each of the light-emitting unit comprising: light source, arranged in the housing; fastening member, arranged in the housing; mounting hole, arranged on the outer wall of the housing; lamp holder, arranged in the mounting hole and fastened to the fastening member; lens, arranged in the lamp holder.

Compared with the existing technology, in the lamp provided by the present invention, each light-emitting unit separately has a mounting hole in the housing, and a fastening member is arranged in the housing, so that the lamp holder can be buckled with the fastening member after mounted in the mounting hole, making it possible for the lamp of the present invention separately provide a lamp holder for each light source. Therefore, a lens can be mounted in the lamp holder to make the light emitted by each light source be emitted through the lens grading and the beam angle of each light source be controlled within a small range, so that the light emitted by the light fixture is concentrated to form light spots and make the light form focused illumination on a certain area or an object so as to highlight the illumination on a certain area or an object.

advantageously, there are multiple light-emitting units which are spaced apart along the length direction of the housing. In this way, the light of the plurality of light-emitting units can be superimposed on each other to form a larger light spot, so that the range of the focused illumination area can be larger.

advantageously, the housing is provided with a mounting member, and the fastening members on multiple light-emitting units are arranged on the mounting member. In this way, a plurality of fastening members are integrally arranged on a mounting member, so that when the lamp is assembled, the plurality of fastening members can be mounted as long as the mounting member is mounted in place, making the mounting of the fastening member convenient. Moreover, the plurality of fastening members are fixedly positioned with each other, so that the plurality of fastening members can be completely positioned as long as the mounting member is positioned, making the mounting positions of the plurality of fastening members not be easily biased.

advantageously, one end of the housing adjacent to the light-emitting unit is provided with a cover cap for covering the end of the housing, and the mounting member is connected and inter-fixed with the cover cap in the length direction of the housing. In this way, the cover cap can cover the end of the housing, and since the mounting member is connected with the cover cap, the mounting member is also fixed after the cover cap is fixed at the end of the housing, so that the interior of the housing does not need to fix the mounting member and make it easier to fix the mounting member.

advantageously, the mounting member is detachably connected to the cover cap. In this way, since the mounting member and the cover cap are generally different in material, in the manufacture of the lamp, the mounting member and the cover cap are generally separately manufactured, and then the mounting member and the cover cap are assembled.

advantageously, a connecting post is arranged on one surface of the cover cap facing the mounting member, and the connecting post is provided with a fourth annular flange, and one end of the mounting member is provided with a tubular connecting part with one end opened and the other end closed, and a notch for connecting the connecting post to the connecting part is arranged on the peripheral wall of the connecting part, and a third annular flange is arranged on the inner wall of the connecting part, and the area between the third annular flange on the connecting part and the closed end of the connecting part is used to clamp the fourth annular flange on the connecting post. In this way, when the cover cap is connected to the mounting member, the annular flange on the connecting post can be simply inserted into the area between the annular flange on the connecting post and the closed end of the connecting part through the notch on the connecting part, and the mounting member is connected to the cover cap, so that the mounting member and the cover cap are conveniently assembled and disassembled.

advantageously, the lens is fastened to the lamp holder. In this way, when the lens is mounted, it is only necessary to fix the lens to the lamp holder, which makes the lens mounting convenient.

advantageously, the housing is provided with a heat conduction strip which contacts with the circuit board in the housing and extends along the length direction of the housing, and an arc part contacting the inner wall of the housing is arranged on any cross section of the heat conduction strip. In this way, when the lamp works, the heat generated by the circuit board is transmitted to the heat conduction strip which distributes the heat evenly to all parts of the housing, so that the temperature of each part of the housing is uniform, and there will be no high temperature in one part of the housing.

advantageously, the lower end of the housing is provided with a mounting mechanism for mounting the lamp, and the mounting mechanism comprises: mounting sleeve, movably sleeved on the housing, where the housing is axially movable along the mounting sleeve, and the mounting sleeve is fixed to the mounting station of the lamp; elastic member, arranged in the mounting sleeve, which is used to exert an elastic clamping force on the housing; limiting member, inserted and fixed to the lower end of the housing, where the limiting member is axially limited with the housing and the lower end of the limiting member is provided with a limiting part for abutting against the lower end of the mounting sleeve. In this way, the housing can be moved axially along the mounting sleeve to facilitate adjustment of the height of the housing, and since the housing is fixed by applying an elastic clamping force to the housing by the elastic member, when adjusting the height of the housing, it is only necessary to pull the housing up or down to move the housing, so that the housing can be stopped after moving at any distance to adjust the height of the housing infinitely.

advantageously, the limiting member comprises two inserting parts axially inserted into the lower end of the housing and in contact with the inner wall of the housing, and one of the inserting parts is axially limited with the housing, and there are gaps between the two inserting parts for the passage of the wires in the housing, and the opposite faces of the two inserting parts are provided with a plurality of teeth for clamping the wires. In this way, the teeth on the two inserting parts can clamp the wires to avoid wire sloshing.

BRIEF DESCRIPTION OF THE DRAWINGS

The drawings described herein are intended to promote a further understanding of the present invention, as follows.

DETAILED DESCRIPTION OF THE INVENTION

Embodiments of the invention are described in detail below, Examples of the embodiments are shown in the appended drawings in which consistently identical or similar labels represent identical or similar elements or elements having the same or similar function. The embodiments described below by reference to the drawings are exemplary and are only used for the interpretation of the invention and cannot be understood to be a limitation of the invention.

Figure 1:
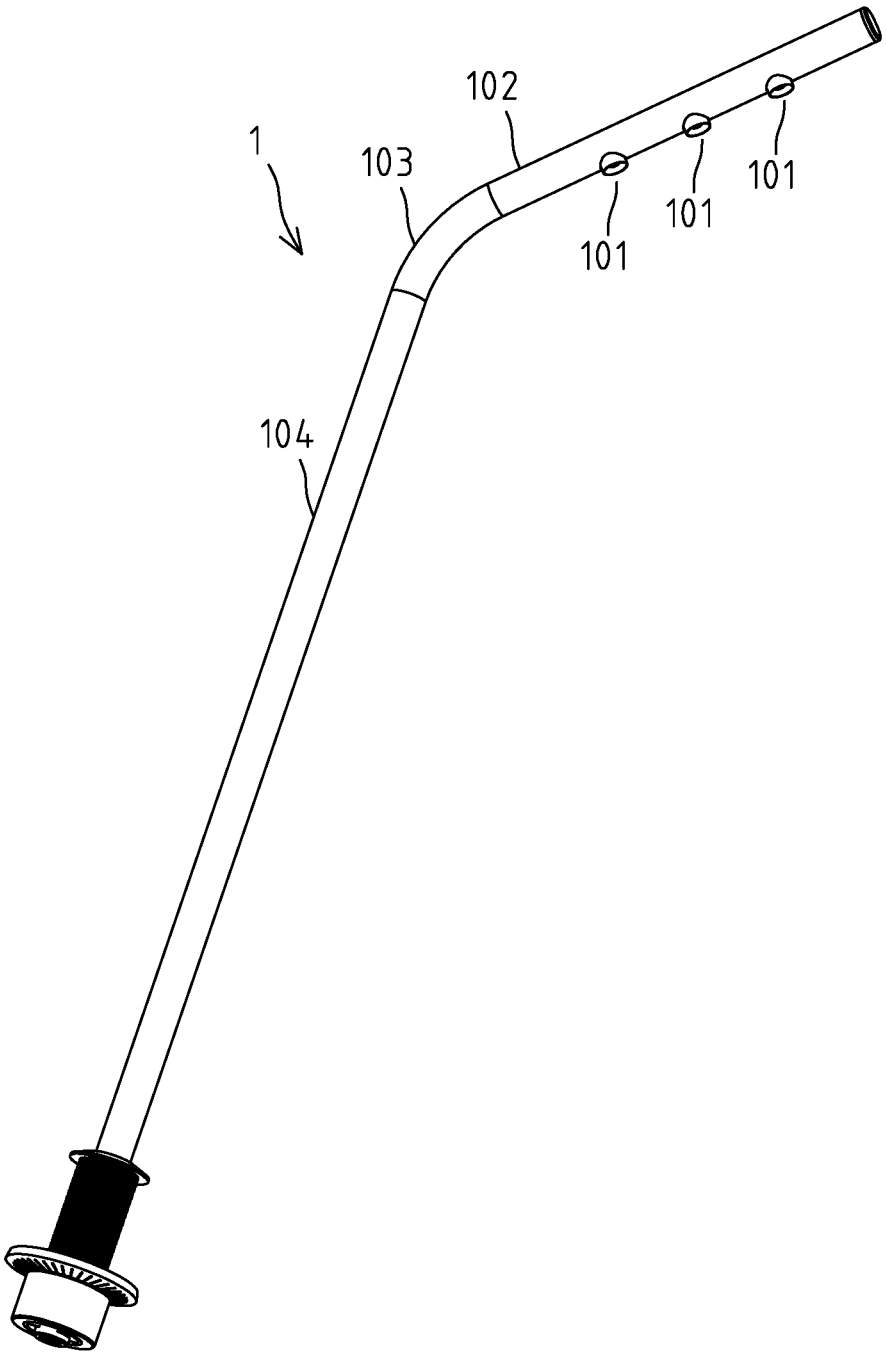
FIG. 1 is a structural schematic diagram of the present invention.
Figure 2:
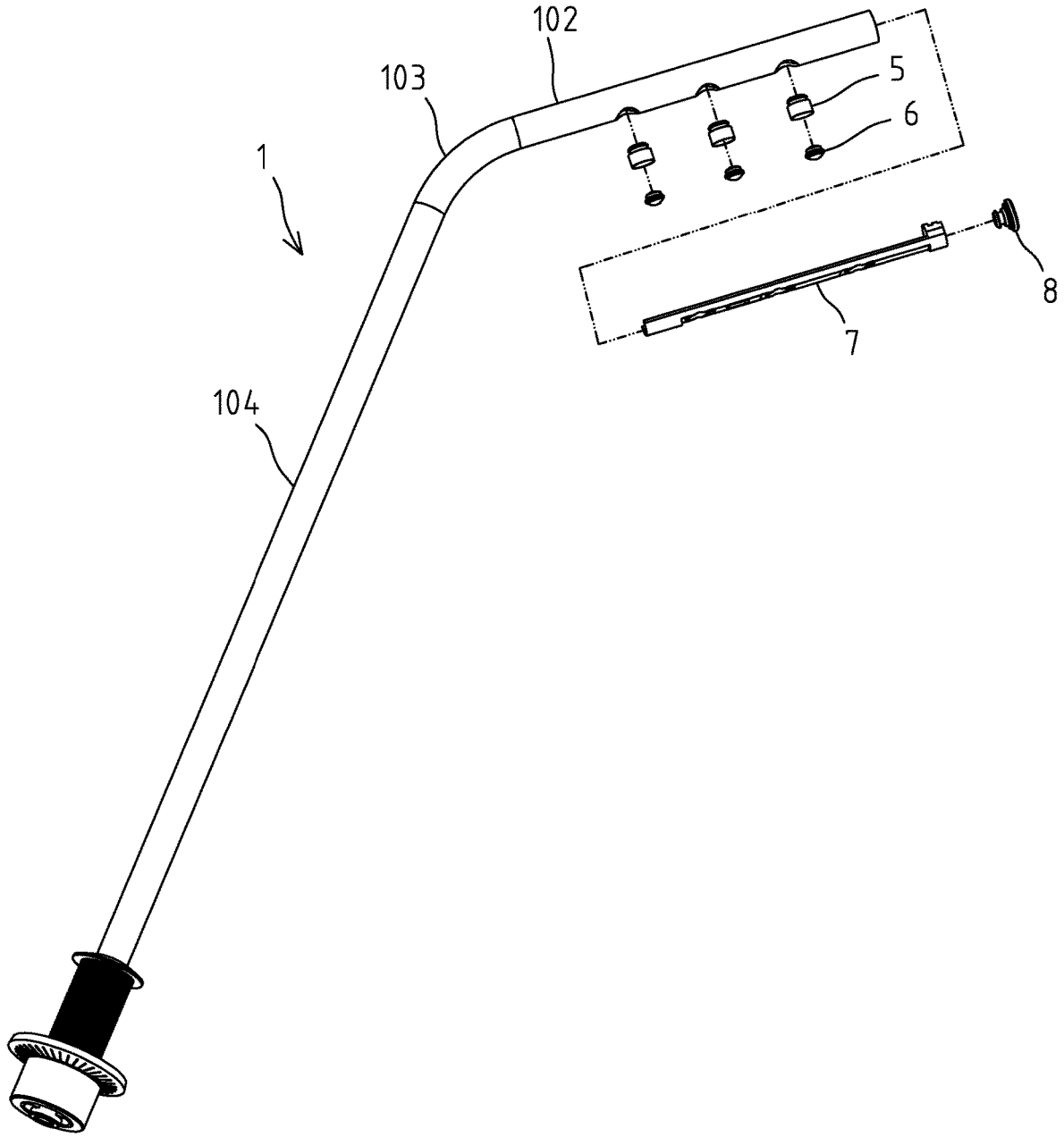
FIG. 2 is an assembly view of the present invention.
Figure 3:
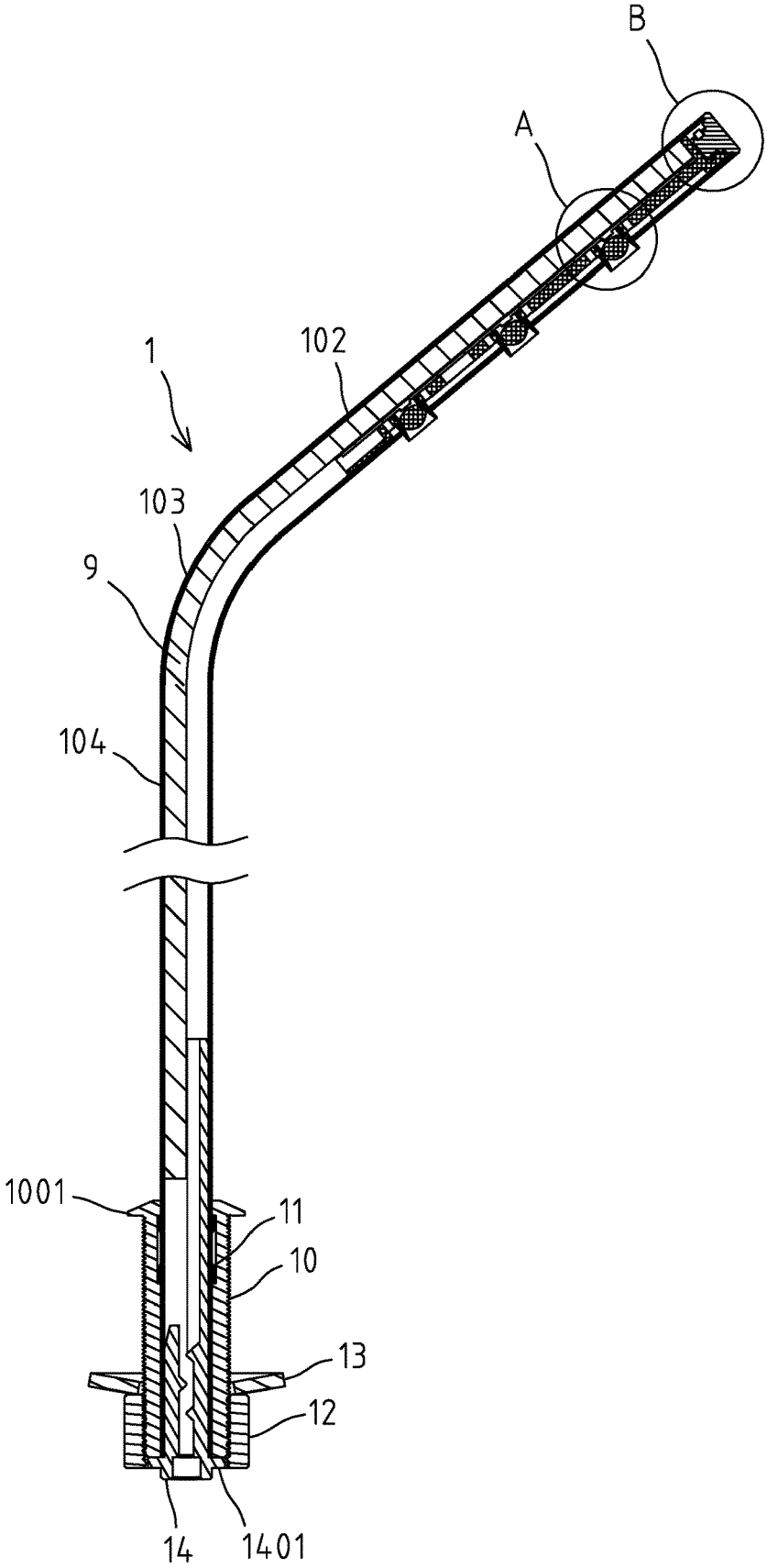
FIG. 3 is a section view of the present invention.

As shown in FIG. 1, FIG. 2 and FIG. 3, the lamp in the embodiment comprises an elongated housing 1 which is an elongated tubular member with a diameter of 0.5-1.5 cm. The housing 1 is provided with a bent part 103 which divides the housing 1 into two parts, one of which is a lamp pole part 104, and the other of which is a lamp head part 102. When the lamp is used, the lamp pole part 104 is vertically arranged, and the lamp head part 102 is inclined. There are three light-emitting units 101 on the lamp head part 102 and the light-emitting directions of the three light-emitting units 101 evenly spaced along the length direction of the housing 1 are inclined downward. The light emitted by three light-emitting units 101 can form a light spot to form a focused illumination for the area to be illuminated. Of course, the number of the light-emitting units 101 can be set according to actual needs without limitation.

Figure 4:
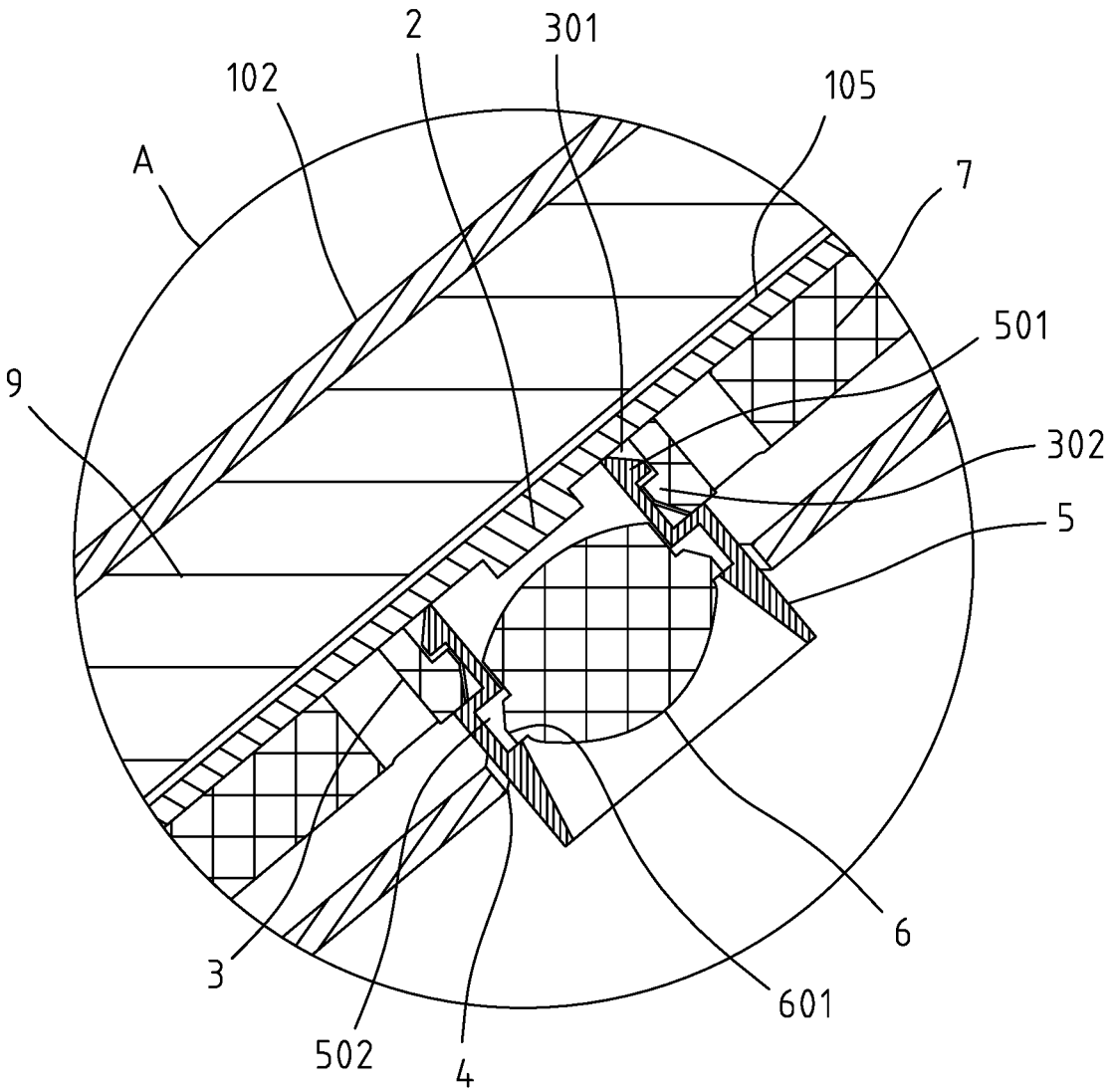
FIG. 4 is an enlarged view of the A region in FIG. 3.
Figure 5:
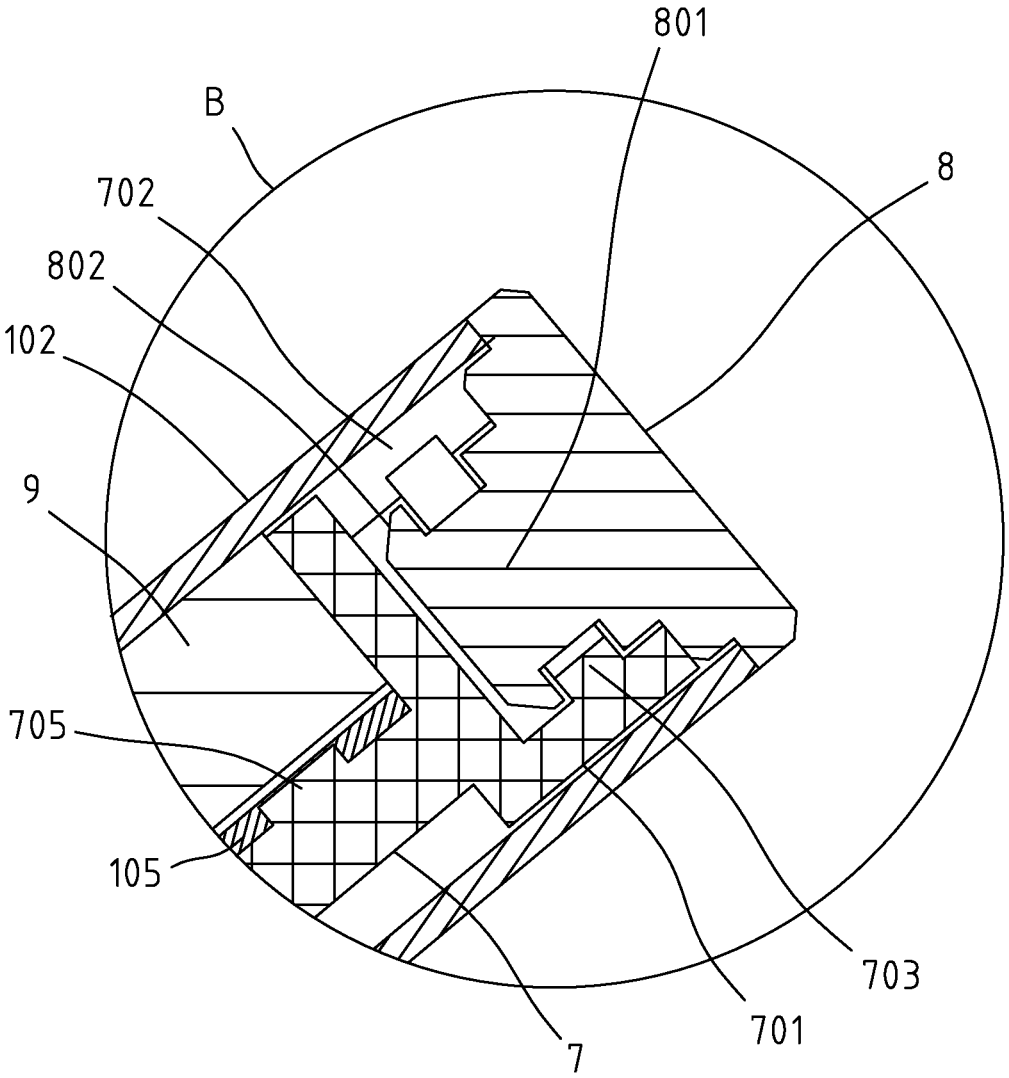
FIG. 5 is an enlarged view of the B region in FIG. 3.
Figure 6:
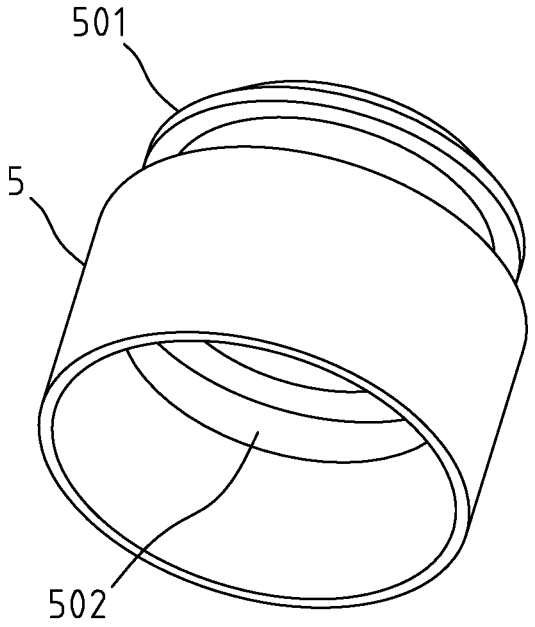
FIG. 6 is a structural schematic diagram of the lamp holder.
Figure 7:
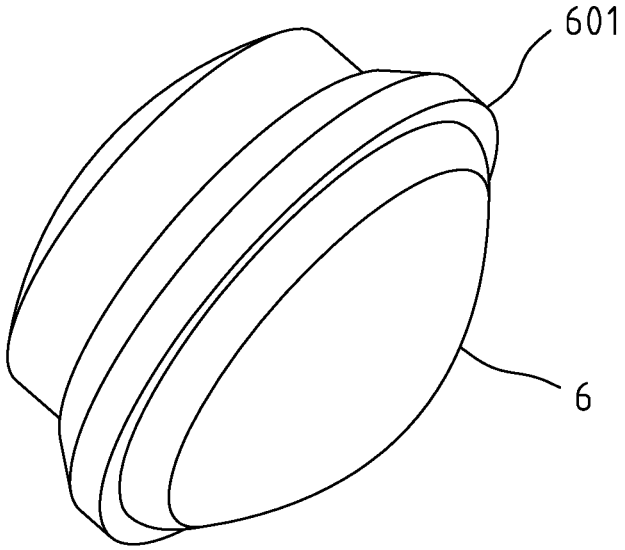
FIG. 7 is a structural schematic diagram of a lens.
Figure 8:
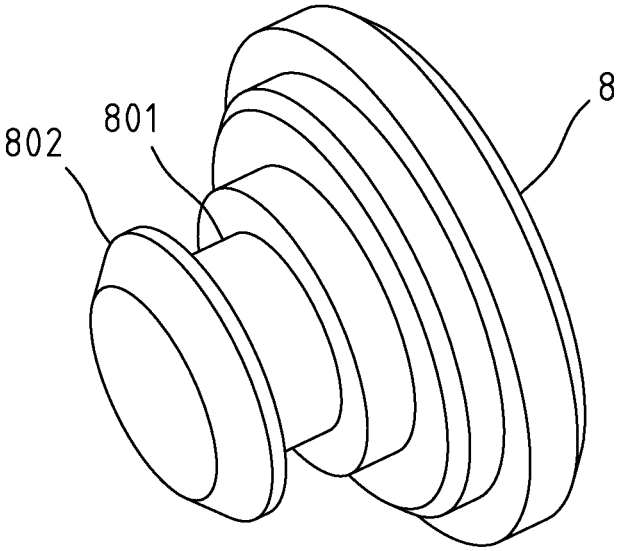
FIG. 8 is a structural schematic diagram of the cover cap.

The structure of one of the light-emitting units 101 will be described below. As shown in FIG. 4, FIG. 6, and FIG. 7, each of the light-emitting units 101 includes a light source 2 arranged in the lamp head part 102, a fastening member 3 arranged in lamp head part 102, a mounting hole 4 arranged on the outer wall of the lamp head part 102, a lamp holder 5 arranged in the mounting hole 4 and fastened to the fastening member 3, and a lens 6 arranged in the lamp holder 5;

The lamp holder 5 is a sleeve-shaped member with two openings at both ends. The inner wall of the lamp holder 5 is provided with an annular card slot 502, the lens 6 is provided with a second annular flange 601, and the axis of the second annular flange 601 coincides with the optical axis of the lens 6. When the lens 6 is installed, the lens 6 is pressed into the lamp holder 5, making the second annular flange 601 be fastened in the annular card slot 502 so as to make the lens 6 be fastened in the lamp holder 5;

The fastening member 3 is provided with a fastening hole 301. The inner wall of the fastening hole 301 is symmetrically provided with two protruding buckles 302. The outer wall of the lamp holder 5 is provided with a first annular flange 501. When the lamp holder 5 is mounted, the lamp holder 5 is inserted into the mounting hole 4 and the fastening hole 301, and the first annular flange 501 is fastened to the two protruding buckles 302 to fix the lamp holder 5;

The light source 2 is an LED which is arranged on the circuit board 105;

When the light-emitting unit is assembled, the lens 6 is fastened and fixed into the lamp holder 5, and then the lamp holder 5 is inserted into the mounting hole 4, and the lamp holder 5 is fastened and fixed in the fastening hole 301 of the fastening member 3, so that the lamp holder 5 can be fixed. After the lamp holder 5 is fixed, the lamp holder 5 covers the light source 2, so that the light emitted by the light source 2 is graded through the lens 6 and then emitted;

The above is the structure and assembly method of one of the light-emitting units, and the structure and assembly method of the other light-emitting units are consistent with that of this light-emitting unit.

Figure 9:
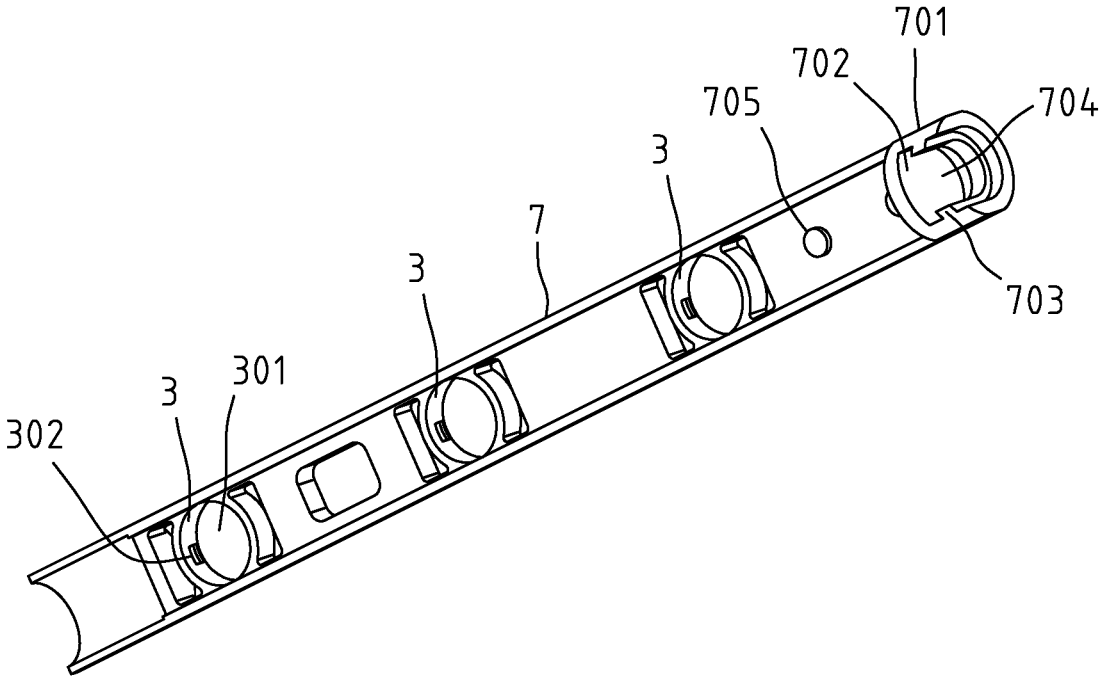
FIG. 9 is a structural schematic diagram of the mounting member.
Figure 10:
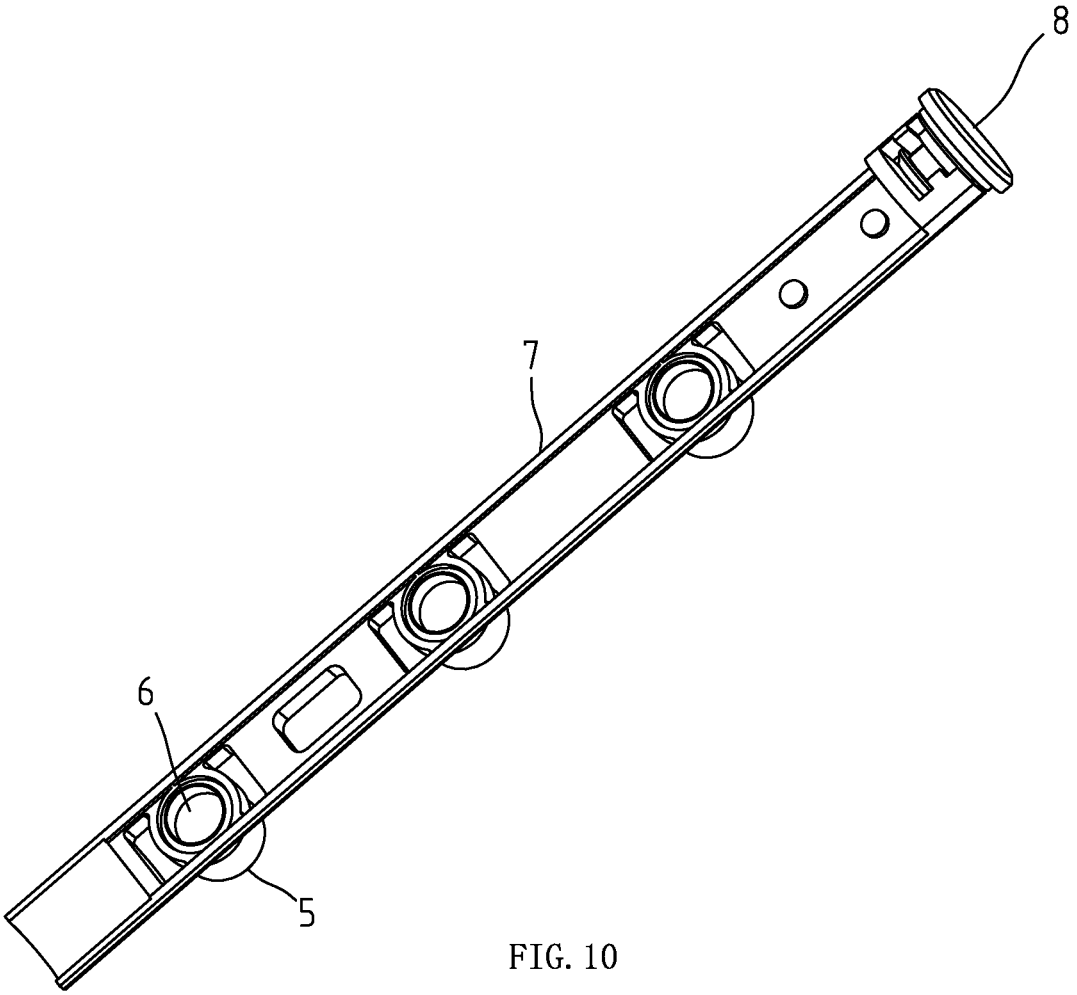
FIG. 10 is a combined view of the mounting member, the cover cap, the lamp holder and the lens.

As shown in FIG. 2, FIG. 9 and FIG. 10, the fastening members 3 on the three light-emitting units 101 are integrally arranged on a mounting member 7 which is elongated, arranged in the housing 1 and provided with two positioning posts 705. The circuit board 105 is provided with two positioning holes, and the circuit board 105 is fixed on the mounting member 7. The two positioning posts 705 on the mounting member 7 are respectively inserted and fixed in two positioning holes on the circuit board to make the relative position of the circuit board 105 to the mounting member 7 be fixed, that is, the positioning post 705 positions the circuit board 105 so that the three light sources 2 on the circuit board 105 are in the three fastening holes 301 on the mounting member 7 respectively.

As shown in FIG. 5, FIG. 8, FIG. 9, and FIG. 10, a cover cap 8 is arranged at one end of the housing 1 adjacent to the light-emitting unit 101, and the cover cap 8 is used to cover the end of the housing 1. The mounting member 7 is connected with the cover cap 8, and the mounting member 7 and the cover cap 8 are fixed in the length direction of the housing 1. In this way, after the cover cap 8 covers the end of the housing 1, the cover cap 8 is fixed, so that the cover cap 8 also positions the mounting member 7. After the mounting member 7 is positioned, the three fastening holes 301 on the mounting member 7 are respectively aligned with the three mounting holes 4 on the housing 1, so that the lamp holder 5 can be mounted to the mounting hole 4 and fastened in the fastening hole 301;

The mounting member 7 is detachably connected to the cover cap 8. Specifically, a connecting post 801 is arranged on one surface of the cover cap 8 facing the mounting member 7. The connecting post 801 is provided with a fourth annular flange 802. One end of the mounting member 7 is provided with a tubular connecting part 701 with one end opened and the other end closed, and a notch 702 for connecting the connecting post 801 to the connecting part 701 is arranged on the peripheral wall of the connecting part 701. A third annular flange 703 is arranged on the inner wall of the connecting part 701, and the area between the third annular flange 703 on the connecting part 701 and the closed end 704 of the connecting part 701 is used to clamp the fourth annular flange 802 on the connecting post 801. In this way, when the cover cap 8 is connected to the mounting member 7, the fourth annular flange 802 on the cover cap 8 can be inserted into the area between the third annular flange 703 on the connecting part 701 and the closed end of the connecting part 701 through the notch 702, so that the fourth annular flange 802 can be axially limited in the area between the third annular flange 703 of the connecting part 701 and the closed end of the connecting part 701 and the cover cap 8 and the mounting member 7 can be axially limited.

Figure 11:
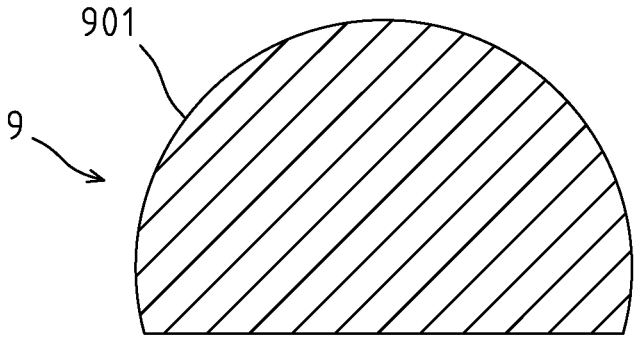
FIG. 11 is a cross-sectional view of a heat conduction strip.

As shown in FIG. 3 and FIG. 11, the housing 1 is provided with a heat conduction strip 9 made of materials that are easy to conduct heat and in contact with the circuit board 105 in the housing 1. The heat generated by the electronic components on the circuit board 105 during operation is conducted to the heat conduction strip 9 which extends along the length direction of the housing 1. Any cross section of the heat conduction strip 9 is provided with an arc part 901 which is in contact with the inner wall of the housing 1, that is, the entire heat conduction strip 9 is in contact with the inner wall of the housing 1. In this way, the heat on the heat conduction strip 9 can be evenly dispersed to all parts of the housing 1 in contact with the heat conduction strip 9, so that the heat is relatively dispersed, the temperature on all parts of the housing 1 is even, and there will be no too high local temperature on housing 1.

As shown in FIG. 3, the lower end of the housing 1 is provided with a mounting mechanism for mounting the lamp, which comprises a mounting sleeve 10, an elastic member 11, a nut 12, a lower support plate 13 and a limiting member 14;

The mounting sleeve 10 is movably arranged in the housing 1, making the housing 1 axially movable along the mounting sleeve 10 which is fixed to the mounting station of the lamp. The outer wall of the mounting sleeve 10 is provided with a thread, and the upper end of the mounting sleeve 10 is provided with an upper support plate 1001 which extends radially outward and can be an annular structure or a plurality of separate support blocks as long as the upper support plate 1001 can support and fix the mounting sleeve 10 on a mounting surface; the elastic member 11 is arranged in the mounting sleeve 10, and the elastic member 11 is used to apply an elastic clamping force to the housing 1, so that the housing 1 can move relative to the mounting sleeve 10 when the axial force is applied to the housing 1. However, the elastic member 11 can clamp and fix housing 1 when the axial force is not applied to the housing 1; the nut 12 is screwed on the mounting sleeve 10, and the nut 12 can move axially relative to the mounting sleeve 10 by rotating the nut 12; the lower support plate 13 is movably sleeved on the mounting sleeve 10, the lower support plate 13 is axially movable relative to the mounting sleeve 10, and the lower support plate 13 is located between the nut 12 and the upper support plate 1001, in this way, when rotating the nut 12, the nut 12 can push the lower support plate 13 to move toward the upper support plate 1001; the limiting member 14 is inserted and fixed in the housing 1, and the limiting member 14 is axially limited with the housing 1. The lower end of the limiting member 14 is provided with a limiting part 1401 for abutting against the lower end of the mounting sleeve 10. In this way, when the force applied to the housing 1 cause the housing 1 to move axially relative to the mounting sleeve 10, the limiting part 1401 can limit the moving distance of the housing 1. As shown in FIG. 3, at this time, the limiting part 1401 abuts against the lower end of the mounting sleeve 10, making the housing 1 unable to continue to move upward so as to prevent the housing 1 from continuing to move upward but make it be removed from the mounting sleeve 10;

When the lamp of the embodiment is installed through the mounting mechanism, it shall be mounted on a bottom plate where there should be a mounting hole. First, the mounting sleeve 10 is inserted into the mounting hole of the bottom plate, so that the upper support plate 1001 on the mounting sleeve 10 abuts against the upper surface of the bottom plate, and then the lower support plate 13 is placed on the mounting sleeve 10, making the lower support plate 13 abut against the lower surface of the bottom plate, then the nut 12 is screwed onto the mounting sleeve to make the nut 12 press the lower support plate 13 against the lower surface of the bottom plate. In this way, the lower support plate 13 and the upper support plate 1001 clamp and fix the mounting sleeve 10 to the bottom plate, the housing 1 is inserted from the upper end of the mounting sleeve 10 and through the mounting sleeve 10, and then the limiting member 14 is inserted into the lower end of the housing 1 for fixation. The wire in the housing 1 can pass through the through hole in the limiting member 14, thus completing the mounting of the lamp of this embodiment.

Figure 13:
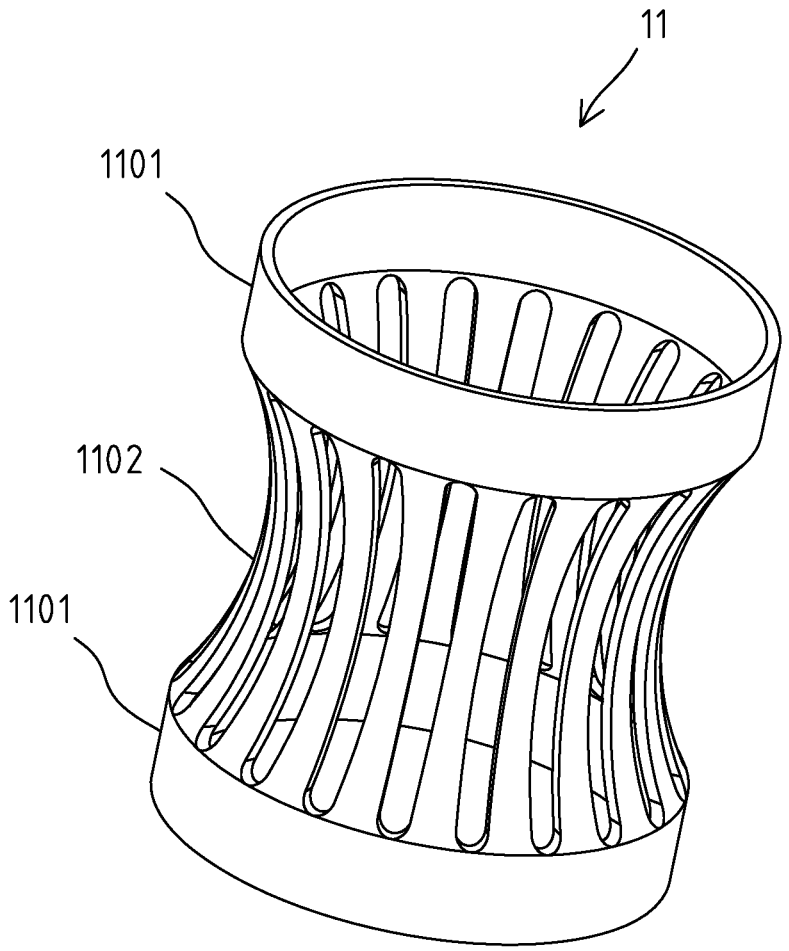
FIG. 13 is a structural schematic diagram of the elastic member.

As shown in FIG. 13, the elastic member 11 comprises two annular members 1101 which are coaxially arranged. A plurality of elastic pieces 1102 are connected between the two annular members 1101 and circumferentially spaced along the annular member 1101. Each of the elastic pieces 1102 is recessed toward the axial direction of the annular member 1101, so that when the housing 1 is inserted into the elastic member 11, a plurality of elastic pieces 1102 can apply an elastic clamping force to the housing 1.

Figure 12:
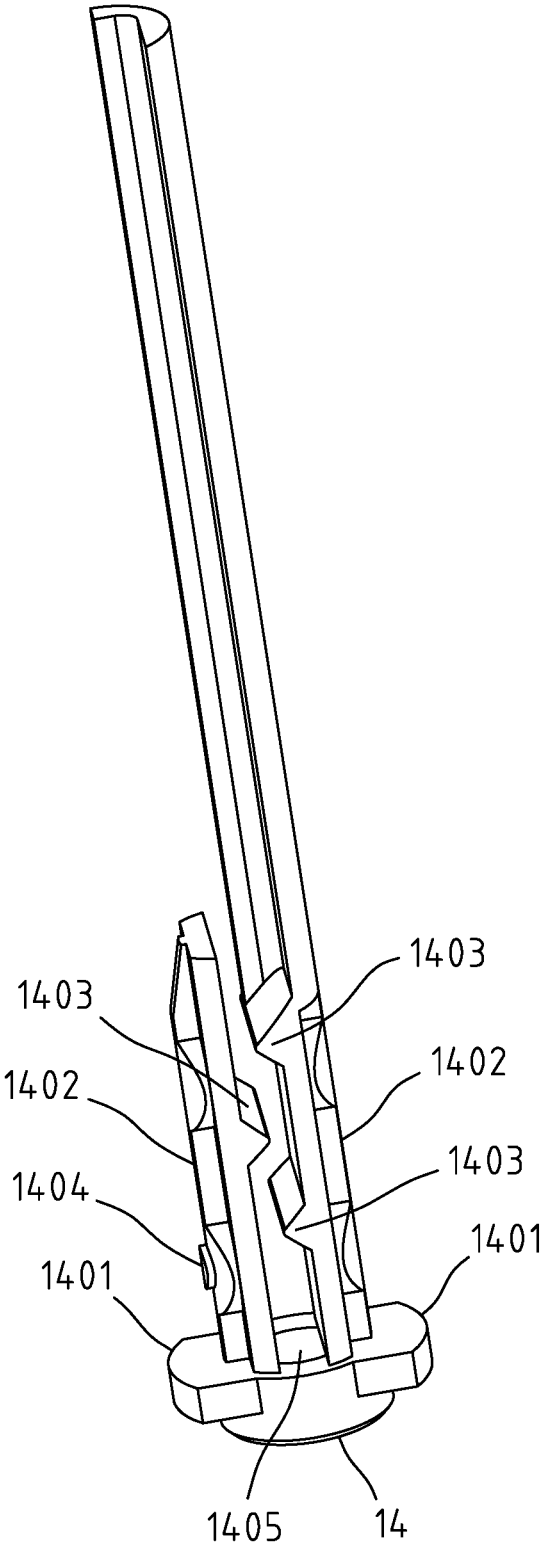
FIG. 12 is a structural schematic diagram of the limiting member.

As shown in FIG. 12, the limiting member 14 comprises two inserting parts 1402 axially inserted into the lower end of the housing 1. The two inserting parts 1402 are in contact with the inner wall of the housing 1, one of the inserting parts is provided with a protrusion 1404 which is arranged on a surface of the inserting part 1402 that is in contact with the inner wall of the housing 1. The inner wall of the housing 1 is provided with a corresponding groove. When the limiting member 14 is inserted into the housing 1, the protrusion 1404 is inserted into the groove to make the limiting member 14 and the housing 1 axial limit, so that the limiting member 14 is fixed with the housing 1. There is a gap between the two inserting parts 1402 for the passage of the wires in the housing 1. The opposite faces of the two inserting parts 1402 are provided with a plurality of teeth 1403, and the wires in the housing 1 are connected to the circuit board 105 in the housing to provide power and control signals to the circuit board 105. The limiting member 14 is provided with a through hole 1405, through which the wires in the housing 1 can be extended. The teeth 1403 on the two inserting parts 1402 are alternately arranged with each other and can clamp the wires through the teeth 1403 on the two inserting parts 1402 to avoid wire sloshing.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A lamp with elongated housing comprises:
an elongated housing;
at least one light-emitting unit arranged on the housing;
the at least one light-emitting unit comprising
a light source attached to the housing;
at least one fastening member attached to the housing and surrounding the light source;
at least one mounting hole defined on an outer wall of the housing and on top of the at least one fastening member;
a lens with a first flange; and
at least one lamp holder for receiving the lens, the at least one lamp holder having a second flange and when the at least one lamp holder being inserted into the at least one mounting hole the second flange engages the at least one fastening member;
wherein the housing has a mounting mechanism comprises
a mounting sleeve, and
an elastic member disposed between the mounting sleeve and the housing,
the at least one lamp holder has an annular card slot for engaging the first flange when the lens is inserted into the at least one lamp holder.

2. The lamp with elongated housing as claimed in claim 1, wherein there are multiple light-emitting units which are spaced apart along a length direction of the housing.

3. The lamp with elongated housing as claimed in claim 2, wherein the housing is provided with at least one mounting member, and the at least one fastening member on the at least one light-emitting unit is arranged on the mounting member.

4. The lamp with elongated housing as claimed in claim 3, wherein one end of the housing adjacent to the at least one light-emitting unit is provided with a cover cap for covering an end of the housing, and the at least one mounting member is connected and inter-fixed with the cover cap in the length direction of the housing.

5. The lamp with elongated housing as claimed in claim 4, wherein the at least one mounting member is detachably connected to the cover cap.

6. The lamp with elongated housing as claimed in claim 5, wherein a connecting post is arranged on one surface of the cover cap facing the at least one mounting member, and the connecting post is provided with a fourth annular flange, and one end of the mounting member is provided with a tubular connecting part with one end opened and the other end closed, and a notch for connecting the connecting post to the tubular connecting part is arranged on a peripheral wall of the connecting part, and a third annular flange is arranged on an inner wall of the connecting part, and an area between the third annular flange on the connecting part and a closed end of the connecting part is used to clamp the fourth annular flange to the connecting post.

7. The lamp with elongated housing as claimed in claim 1, wherein the housing is provided with a heat conduction strip which contacts with a circuit board in the housing and extends along a length direction of the housing, and an arc part contacting an inner wall of the housing is arranged on a cross section of the heat conduction strip.

8. The lamp with elongated housing as claimed in claim 1, wherein the mounting mechanism further comprises
a limiting member, inserted and fixed to a lower end of the housing, where the limiting member is axially limited with the housing and a lower end of the limiting member is provided with a limiting part for abutting against a lower end of the mounting sleeve.

9. The lamp with elongated housing as claimed in claim 8, wherein the limiting member comprises two inserting parts axially inserted into the lower end of the housing and in contact with an inner wall of the housing, and one of the inserting parts is axially limited with the housing, and there are gaps between the two inserting parts for passage of wires in the housing, and opposite faces of the two inserting parts are provided with a plurality of teeth for clamping the wires.

* * * * *